US008695983B1

(12) United States Patent
DeJaynes

(10) Patent No.: US 8,695,983 B1
(45) Date of Patent: Apr. 15, 2014

(54) GAME PLAYED WITH TILES

(76) Inventor: Arnold M. DeJaynes, New London, IA (US)

( * ) Notice: Subject to any disclaimer, the term of this patent is extended or adjusted under 35 U.S.C. 154(b) by 45 days.

(21) Appl. No.: 13/494,478

(22) Filed: Jun. 12, 2012

Related U.S. Application Data

(60) Provisional application No. 61/496,745, filed on Jun. 14, 2011.

(51) Int. Cl.
*A63F 1/00* (2006.01)

(52) U.S. Cl.
USPC ..... 273/292

(58) Field of Classification Search
None
See application file for complete search history.

(56) References Cited

U.S. PATENT DOCUMENTS 2,289,690 A * 7/1942 Bakalyar ..... 446/2
2,587,042 A * 2/1952 Haiselup ..... 446/2
2,776,835 A * 1/1957 Wilson ..... 273/259
3,315,404 A * 4/1967 Rosen ..... 446/2
3,621,601 A * 11/1971 Greenburg ..... 446/2
4,138,797 A * 2/1979 Stolar ..... 446/2
4,358,274 A * 11/1982 Chase ..... 434/205
4,632,664 A * 12/1986 Manning ..... 446/2
4,740,185 A * 4/1988 Inglee ..... 446/2
4,880,235 A * 11/1989 Groenewold ..... 463/60
4,988,109 A * 1/1991 Li ..... 273/281
4,998,902 A * 3/1991 Garner et al. ..... 446/2
5,083,960 A * 1/1992 Erickson ..... 446/2
5,122,087 A * 6/1992 Coccoli et al. ..... 446/2
5,405,281 A * 4/1995 Sandor ..... 446/2
5,533,919 A * 7/1996 Peterson ..... 446/2

* cited by examiner

*Primary Examiner* — Kurt Fernstrom
*Assistant Examiner* — Dolores Collins
(74) *Attorney, Agent, or Firm* — James C. Nemmers; Shuttleworth & Ingersoll, PLC

(57) ABSTRACT

An entertaining game played with multiple specially designed tiles mounted on sections of miniature tracks similar to railroad tracks. The tiles are individually designed and mounted so that the sections of tracks can be connected in a straight path, can bank on curves and can go up and down inclines to create almost unlimited patterns. Once the path is created and with the tiles upright, the tile at one end can be tipped causing the tiles along the entire path of travel to tip in succession, thus producing a unique and fun effect. Since the tiles are permanently mounted on the sections of track, the set up time is quick, and once the user has created a desired pattern, the tiles can be moved to the upright position very quickly. When the first tile is tipped and the tiles have fallen along all the paths created, they can be quickly reset.

5 Claims, 3 Drawing Sheets

GAME PLAYED WITH TILES

This application claims priority under 35 USC 119 to Provisional Patent Application Ser. No. 61/496,745 filed on Jun. 14, 2011, the entire contents of which are hereby incorporated by reference.

BACKGROUND OF THE INVENTION

Dominos generally refers to the collective gaming pieces making up a domino set or to the subcategory of tile games played with domino pieces or similar tiles, which tiles are typically about twice as long as they are wide. However, these tiles have long been used by individuals for entertainment by setting the individual tiles spaced apart on a flat surface in various curves and branches. The end tile is then tipped which tips all the other tiles in succession to create a fun and interesting effect. Frequently, hundreds of tiles are used and set up in various patterns to create unique effects. However, the tiles must always be set on a smooth, flat surface and cannot be set up on either up or down grades. Moreover, to set these tiles up takes considerable time and effort, which detracts from the entertainment value.

SUMMARY OF THE INVENTION

My invention provides a way of pivotally mounting the tiles on miniature tracks connected by ties similar to railroad tracks. The tiles are individually designed and mounted so that the tracks can run straight, can bank on curves and can go up and down grades to create almost unlimited patterns of travel that produce unique and fun effects. Since the tiles are permanently mounted on sections of track, the set up time is quick, and once the user has created a desired pattern, the tiles can be moved to the upright position very quickly, even by young children. When the first tile is triggered and the tiles have fallen along all the paths created, they can be reset in minutes or even seconds of time.

DETAILED DESCRIPTION OF A PREFERRED EMBODIMENT OF THE INVENTION

Figure 1:
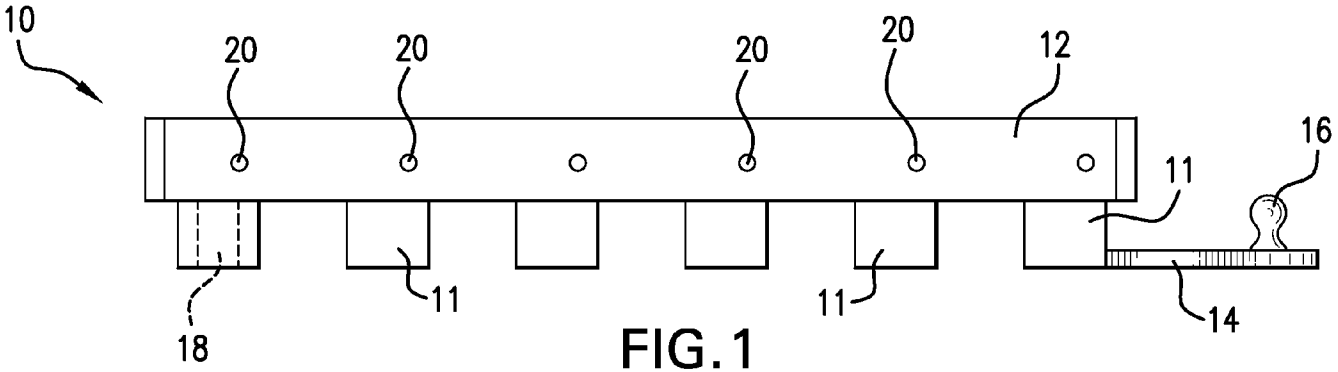
FIG. 1 is a side elevational view of a section of track onto which the tiles are mounted.
Figure 2:
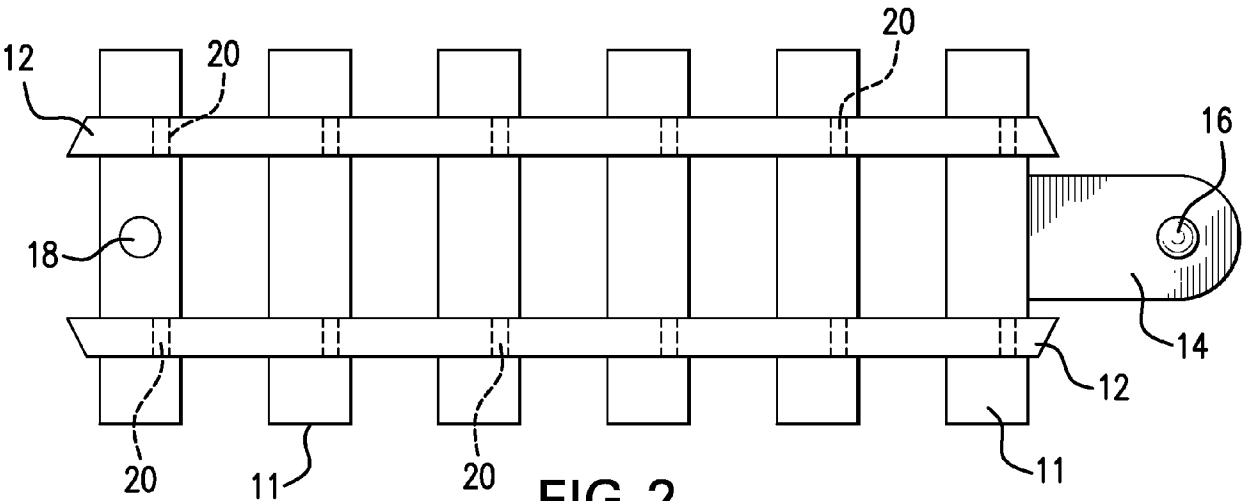
FIG. 2 is a top view of the section of track of FIG. 1.

FIGS. 1 and 2 show a section of a track 10 which is comprised of parallel, spaced-apart rails 12 held together by a plurality of cross ties 11. At one end of the track 10 there is affixed to the cross tie 11 at that end a connector plate 14 containing an upstanding male connector 16. The cross tie 11 at the other end of the track 10 is provided with a vertical opening 18 to receive a connector 16, thereby providing for easy connection of sections of the track 10. Each rail 12 has a plurality of spaced-apart holes 20 extending horizontally through it, the holes 20 being spaced apart on the rails 12 so that there is a hole 20 above each cross tie 11 and slightly offset from the center of the cross tie 11. As best seen in FIG. 2, the holes 20 on one rail 12 are aligned with the holes 20 on the other rail 12. The spacing of the holes 20 is such as to allow the tiles 22 described hereinafter (see FIGS. 3 and 4) to be mounted on the rails 12 so that each tile 22 will be slanted about 18° from a plane perpendicular to the rails 12 in the manner described hereinafter.

Figure 3:
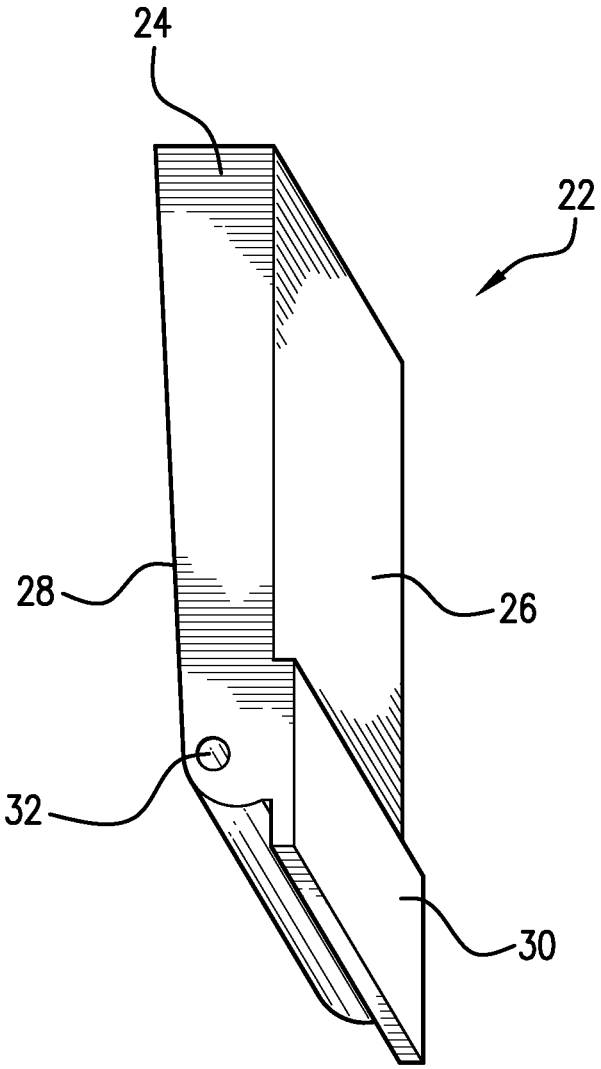
FIG. 3 is a perspective view of an individual tile.
Figure 4:
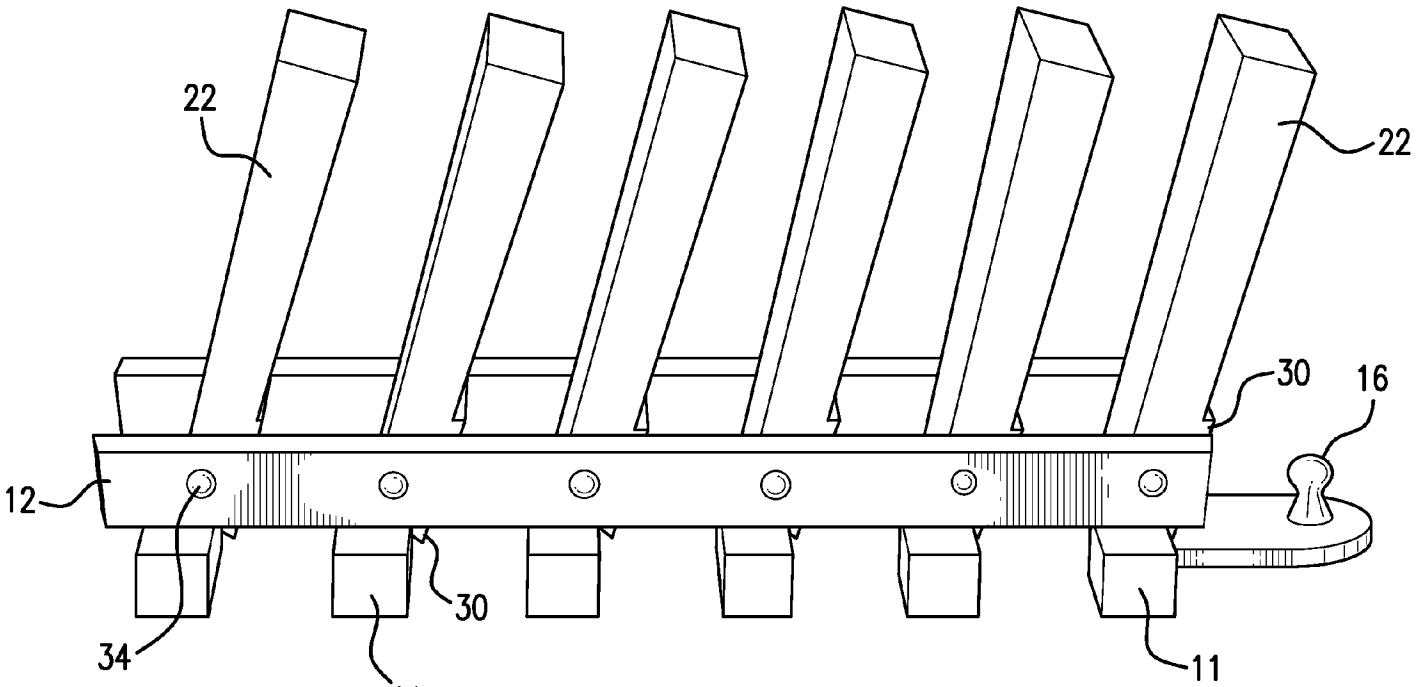
FIG. 4 is a perspective view of several tiles assembled to a section of track.

Referring now to FIG. 3, there is shown one of the tiles 22 which has a main body 24 having a front side 26 and a back side 28. The main body 24 is tapered from top to bottom so that the back side 28 extends upwardly and outwardly relative to the front side 26 thus making the main body 24 thicker and thus heavier at the top. Formed at the lower end of the main body 24 is a stop member 30 which is offset from the front side 26 and extends downwardly generally parallel to the front side 26. A pivot hole 32 is formed in the lower end of the main body 24, which pivot hole 32 is offset toward the back side 28. A suitable pivot pin 34 extends through each hole 20 on each rail 12 into the pivot hole 32 of a tile 22 to pivotally mount the tile 22 between the rails 12 with the stop member 30 extending downwardly between adjacent cross ties 11, as best seen in FIG. 4. The pivot pins 34 preferably are push pins of a well known type to make the assembly of the tiles 22 and rails 12 quick and easy. Once the tiles 22 are assembled to the rails 12, the stop member 30 of each tile 22 will therefore allow the tile 22 to pivot in one direction only. The spacing of holes 20 is close enough that when a tile 22 pivots and falls, it will strike the adjacent tile 22 and cause it to fall. Also, the positioning of the holes 20 in the rails 12 relative to the cross ties 11 is such that when a tile 22 is mounted between the rails 12, the heavier top of the main body will cause the tile 22 to tip slightly until the stop member 30 engages a cross tie 11, thereby providing for the mounting of each tile 22 at an tilted angle from the vertical of about 18°.

FIG. 4 shows a view of a section of track 10 with multiple tiles 22 assembled to a section of track 10. The sections of track 10 are then connected using the male and female connectors 16 and 18. The sections of track 10 can be arranged by the user in any desired pattern along any desired path, the length of which is unlimited. The assembled sections of track 10 can also be mounted on an incline, either up or down, inclined up to about 20° from the vertical. The sections of track 10 can be arranged on inclines without tipping the tiles 22 because of the stops 30 and the manner of the tile design and mounting of the tiles 22 on the tracks 10 at an angle. Once the sections of track 10 are connected together in a desired pattern along a desired path, the user merely has to tip the tile 22 at one end of the path and the tiles will fall in succession along the entire path creating an entertaining effect. To set or reset tiles, the user merely has to run his or her fingers along the tiles 22 to return them to an erect position. This can be done easily and quickly, usually in a manner of seconds.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. A game to be played for entertainment and fun, said game comprising:

a track having a pair of spaced apart rails extending substantially parallel to each other thereby providing an open space all along and between the rails, each rail having a plurality of substantially equally spaced-apart openings extending transversely to the rail, an opening in one rail being opposite a corresponding opening in the other rail;

a plurality of spaced-apart cross ties affixed to the rails beneath the rails and supporting the rails in a fixed position, the ties being spaced apart substantially the same distance as the openings in the rails so that a tie is positioned beneath each pair of openings in the rails;

a pivot member received in each opening in the rails;

and a plurality of tiles pivotally mounted in the open space between the rails on the pivot members with the tiles normally extending upwardly;

each tile having a main body with a top, a bottom, a front side and a back side, the main body being thicker at the top between the front side and the back side, each tile having a pivot hole near its bottom and offset toward the back side so as to pivotally mount the tile on a pivot member, the tile having a stop member offset from the front side and extending downwardly from the bottom of the time to extend between the cross ties in a position to engage a cross tie so as to maintain the tile in its upwardly extending position while allowing the tile to pivot and swing downwardly toward its back side and in one direction only;

the distance between adjacent pivot members being less than the distance from a pivot member to the top of the tile mounted on the pivot member;

whereby pivoting of one tile in the one direction will cause the tile to engage the adjacent tile and cause it to pivot.

2. The game of claim 1 in which the track is comprised of short sections and each section has a male connector at one end and a female connector at the other end, the sections being connectable to form a selected path that can travel up and down inclines and around curves.

3. The game of claim 1 in which the main body of each tile is tapered from top to bottom so that the back side extends upwardly and outwardly relative to the front side thus making the main body thicker and thus heavier at the top.

4. The game of claim 3 in which the stop member of the tile is offset from the front side and extends downwardly generally parallel to the front side, a pivot hole is formed near the bottom of the main body and is offset toward the back side of the main body, the pivot hole being adapted to receive a pivot member.

5. The game of claim 2 in which a portion of the path inclines, and each tile along the incline is tilted from the vertical at an angle less than the angle of the incline of the path.

* * * * *